US006677702B2

(12) United States Patent
Kim et al.

(10) Patent No.: US 6,677,702 B2
(45) Date of Patent: Jan. 13, 2004

(54) FLAT TYPE COLOR CATHODE RAY TUBE

(75) Inventors: Yong Kun Kim, Gumi-si (KR); Yoon San Park, Gumi-si (KR); Hyeon Soo Hong, Gimi-si (KR)

(73) Assignee: LG Philips Displays Korea Co., Ltd., Gyeongsahgbuk-do (KR)

( * ) Notice: Subject to any disclaimer, the term of this patent is extended or adjusted under 35 U.S.C. 154(b) by 24 days.

(21) Appl. No.: 10/157,854

(22) Filed: May 31, 2002

(65) Prior Publication Data

US 2003/0117060 A1 Jun. 26, 2003

(30) Foreign Application Priority Data

Dec. 19, 2001 (KR) ..... 10-2001-81418

(51) Int. Cl.[7] ..... H01J 31/00
(52) U.S. Cl. ..... 313/477 R; 220/2.1 A
(58) Field of Search ..... 313/461, 477 R, 313/463, 464, 466, 364, 400, 407, 408; 220/2.1 A, 2.3 A, 2.1 R; H01J 61/30

(56) References Cited

U.S. PATENT DOCUMENTS 5,536,995 A * 7/1996 Sugawara et al. ..... 313/477 R
RE36,838 E * 8/2000 Sugawara et al. ..... 313/477 R
6,160,344 A * 12/2000 Cho et al. ..... 313/477 R
6,232,712 B1 * 5/2001 Pyun et al. ..... 313/477 R
6,337,535 B1 * 1/2002 Kim ..... 313/461
6,407,496 B2 * 6/2002 Pyun et al. ..... 313/477 R
6,459,196 B1 * 10/2002 Cho et al. ..... 313/477 R
2002/0105257 A1 * 8/2002 Pyun et al. ..... 313/408

* cited by examiner

*Primary Examiner*—Don Wong
*Assistant Examiner*—Trinh Vo Dinh
(74) *Attorney, Agent, or Firm*—Birch, Stewart, Kolasch & Birch, LLP

(57) ABSTRACT

Disclosed is a flat type color cathode ray tube of high quality, which is capable of maintaining a brightness and brightness uniformity of an image while improving contrast, thereby ensuring flatness and visual distinction of the image. The flat type color cathode ray tube comprises a panel having an outer surface which is substantially flat and an inner surface which takes a predetermined curvature. The panel possesses at a center part thereof a transmittance of 45%~75%, and the inner surface of the panel possesses an on-diagonal-axis curvature $R_D$ which satisfies a correlation, $3.5R \leqq R_D \leqq 8.0R$ where R is a product of 1.767 and a diagonal length of an effective surface along a diagonal axis.

13 Claims, 7 Drawing Sheets

Fig.3C
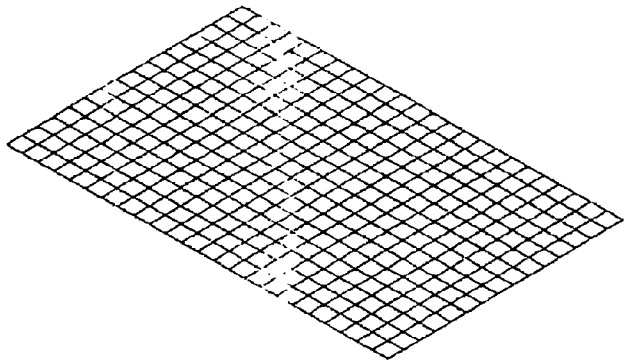
Outer surface of panel
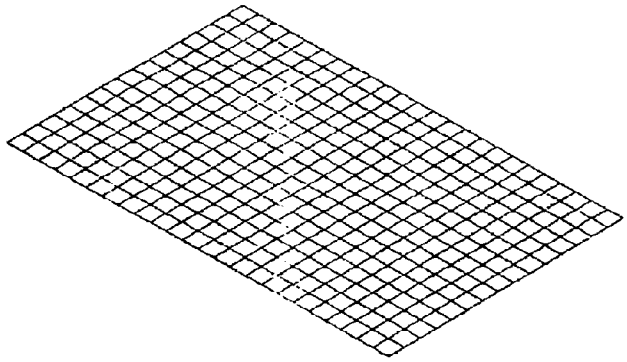
Image displayed by image floating effect
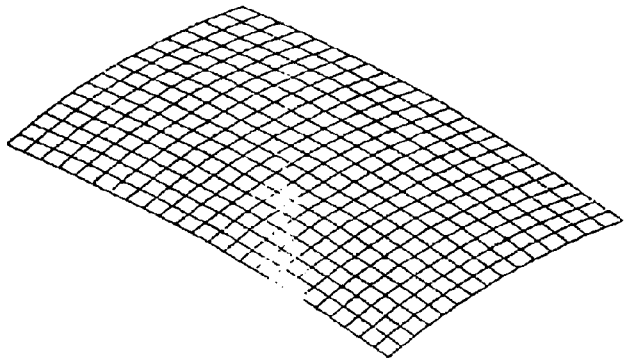
Inner surface of panel

FLAT TYPE COLOR CATHODE RAY TUBE

BACKGROUND OF THE INVENTION

1. Field of the Invention

The present invention relates to a flat type color cathode ray tube, and more particularly, the present invention relates to a flat type color cathode ray tube of high quality, which is capable of guaranteeing brightness uniformity while improving contrast, thereby ensuring flatness and visual distinction of an image.

2. Description of the Related Art

Referring to FIG. 1, there is shown a partially sectioned side view schematically illustrating a construction of a color cathode ray tube. The color cathode ray tube includes a panel 1 defining a front surface of the cathode ray tube, a shadow mask 3 performing a function of selecting colors of emitted electron beams 11 in the panel 1, a frame 4 for fastening and supporting the shadow mask 3, a stud pin 6 for securing the frame 4 to the panel 1, a spring 5 for connecting the stud pin 6 and the frame 4 with each other, a funnel 2 coupled to a rear end of the panel 1 to maintain the inside of the panel 1 under a vacuum pressure, a tubular neck section 10 extending rearward from a rear end of the funnel 2, an electron gun 8 mounted in the neck section 10 to emit electron beams 11, an inner shield 17 assembled to the frame 4 to protect the emitted electron beams 11 from an external magnetic field, a deflection yoke 9 surrounding a circumferential outer surface of the funnel 2 to deflect the electron beams 11, a reinforcing band 12 for preventing implosion of the cathode ray tube maintained under a high vacuum pressure, and a lug 13 for fastening the reinforcing band 12 to the cathode ray tube.

Curvatures of inner and outer surfaces of the panel 1 influence an implosion-resistant characteristic and visual distinction of an image displayed on the panel 1.

In particular, a curvature of the inner surface of the panel 1 significantly affects flatness and distortion of an image, to thereby influence the visual distinction. Also, the curvature of the inner surface of the panel 1 affects a transmittance of the panel 1 and transmittance formation, so as to ensure brightness uniformity and allow light and dark regions on a picture image to be easily distinguished. That is to say, a precise inner surface curvature of the panel 1 plays an important role in realizing a cathode ray tube of high quality.

In the cathode ray tube constructed as mentioned above, the electron beams 11 emitted from the electron gun 8 are deflected by the deflection yoke 9 and then pass through apertures defined in the shadow mask 3, in a manner such that they are impinged onto fluorescent materials applied on the inner surface of the panel 1 and respectively aligned with the apertures of the shadow mask 3, to display a picture image.

At this time, a contour of the picture image is determined by the inner and outer surfaces of the panel 1. In other words, depending upon curvatures of the inner and outer surfaces of the panel 1, when a picture image initially created by emitting electron beams onto the fluorescent materials applied to the inner surface of the panel 1 passes through the panel 1, a contour of the picture image is changed by refraction of light, and the resultantly displayed picture image has a curved contour depending on the curvatures of the inner and outer surfaces.

It is to be noted that excellent clarity of a picture image displayed on the cathode ray tube can be accomplished by ensuring brightness uniformity and allowing light and dark regions to be easily distinguished on the picture image, depending upon a transmittance as well as a curvature of the panel 1.

Recently, the ever increasing demand for a large-sized flat cathode ray tube has led to enlargement and flattening of the panel 1. FIG. 2*a* is a side cross-sectional view independently illustrating a contour of a curved panel which has curvatures on both inner and outer surfaces thereof; and FIG. 2*b* is a side cross-sectional view independently illustrating a contour of a flat panel which has a curvature only on an inner surface thereof.

An inner surface curvature of a panel can be expressed by a "wedge rate" which is a thickness ratio between a center part and a diagonal end part of the panel. As can be readily understood from FIG. 2*b*, the conventional flat panel having a curvature only on an inner surface thereof possesses a wedge rate of no less than 200%. When considering the fact that the conventional curved panel having curvatures on both inner and outer surfaces thereof possesses a wedge rate of about 130%, the conventional flat panel tends to be overly increased in its thickness at a peripheral part thereof, especially at the diagonal end part. Consequently, as a difference between transmittances of the center part and the peripheral part is increased, when a picture image is created on the panel, a remarkable difference exists between brightnesses of the center and peripheral parts, so that eye strain is caused.

To cope with this problem, a method has been disclosed in the art, in which a panel is formed to have at a center part thereof a high transmittance of no less than 85%. By this method, even though a thickness is increased at the peripheral part of the panel, since a transmittance is not decreased at the peripheral part, it is possible to maintain brightness uniformity.

While capable of maintaining brightness uniformity of a picture image, this method has disadvantages in that, since an excessively high luminance is produced over an entire surface of the picture image, strain of the eye is increased. Also, because an unfavorable phenomenon which deteriorates contrast as a distinguishability between lightness and darkness results in, when a cathode ray tube is turned on under a bright surrounding condition, eye strain occurs. Further, in this bright surrounding condition, even when the cathode ray tube is turned off, a favorable viewing condition cannot be rendered.

In order to overcome these disadvantages, a brightness of the picture image as a whole should be decreased. To this end, there have been disclosed in the art techniques of applying a coating on the panel for the purpose of adjusting a transmittance and attaching a film having a low transmittance to the panel. Nevertheless, these techniques still encounter problems in that additional processes and manufacturing costs are incurred to form the panel.

Further, in the case of decreasing a transmittance only at the center part of the panel with an aim of enhancing a contrast between light and dark regions, because the conventional cathode ray tube has a wedge rate of 200%, which is calculated as a thickness ratio between the center part and the diagonal end part of the panel, a transmittance is decreased at the peripheral part, and thereby, brightness uniformity of the picture image cannot be guaranteed.

SUMMARY OF THE INVENTION

Accordingly, the present invention has been made in an effort to solve the problems occurring in the related art, and an object of the present invention is to provide a flat type color cathode ray tube of high quality, which is capable of maintaining a brightness and brightness uniformity of an image while improving contrast as a distinguishability between lightness and darkness, thereby ensuring flatness and visual distinction of the image.

In order to achieve the above object, according to one aspect of the present invention, there is provided a flat type color cathode ray tube comprising: a rectangular panel having an outer surface which is substantially flat and an inner surface which takes a predetermined curvature, the rectangular panel being formed with a skirt part which extends substantially perpendicularly to the inner and outer surfaces; a shadow mask for performing a function of selecting colors of emitted electron beams in the panel; a frame for applying tensioning force to the shadow mask and supporting the shadow mask; a funnel coupled to a rear end of the panel to maintain the inside of the panel under a vacuum pressure; a tubular neck section extending rearward from a rear end of the funnel; an electron gun mounted in the neck section to emit electron beams; and a deflection yoke surrounding a circumferential outer surface of the funnel to deflect electron beams; wherein the panel possesses at a center part thereof a transmittance of 45%~75%, and the inner surface of the panel possesses an on-diagonal-axis curvature $R_D$ which satisfies the following inequality (1):

$$3.5R \leqq R_D \leqq 8.0R \quad (1).$$

According to another aspect of the present invention, there is provided a flat type color cathode ray tube comprising: a panel having an outer surface which is substantially flat and an inner surface which takes a predetermined curvature, the inner surface of the panel possessing an on-major-axis curvature $R_X$, an on-minor-axis curvature $R_Y$ and an on-diagonal-axis curvature $R_D$ which respectively satisfy correlations, $4.5R_{XO} \leqq R_X \leqq 8.0R_{XO}$, $2.5R_{YO} \leqq R_Y \leqq 8.0R_{YO}$ and $3.5R_{DO} \leqq R_D \leqq 8.0R_{DO}$.

According to still another aspect of the present invention, there is provided a flat type color cathode ray tube comprising: a panel having an outer surface which is substantially flat and an inner surface which takes a predetermined curvature, the panel possessing at a center part thereof a transmittance of 45%~75%, the panel further possessing a wedge rate as a thickness ratio between the center part and a diagonal end part of the panel, which satisfies a correlation, 1.4≦wedge rate≦2.0.

BRIEF DESCRIPTION OF THE DRAWINGS

The above objects, and other features and advantages of the present invention will become more apparent after a reading of the following detailed description when taken in conjunction with the drawings, in which:

FIG. 3*c* shows views illustrating inner and outer surfaces of a flat panel and a picture image displayed by the image floating effect in a flat type cathode ray tube;

FIG. 5*b* is a partial schematic view illustrating a wedge rate, which is a thickness ratio between the center part and the diagnal end part of the panel, where $t_{center}$, $t_d$ are thickness of the center part, and the diagnal end part, respectively, of the panel.

DETAILED DESCRIPTION OF PREFERRED EMBODIMENTS

Figure 1:
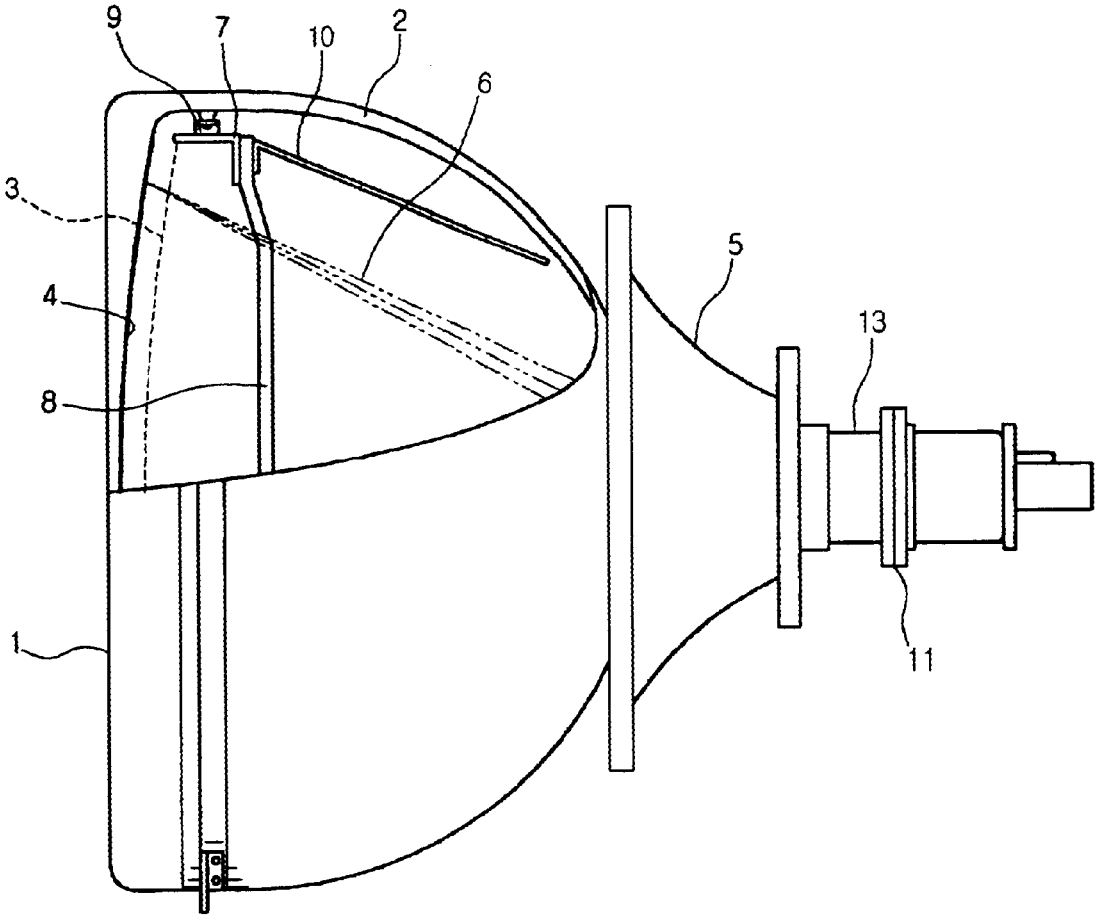
FIG. 1 is a partially sectioned side view schematically illustrating a construction of a color cathode ray tube.

Reference will now be made in greater detail to a preferred embodiment of the invention, an example of which is illustrated in the accompanying drawings. Wherever possible, the same reference numerals will be used throughout the drawings and the description to refer to the same or like parts.

In a cathode ray tube, in order to prevent color contamination of a picture image, a conventional flat panel having a curvature only on an inner surface thereof possesses a substantial wedge rate of no less than 200%, which wedge rate is a thickness ratio between a center part and a diagonal end part of the panel. In this connection, in the case of a flat panel having a wedge rate of less than 200%, it is difficult to secure brightness uniformity over the center part and a peripheral part of the panel.

To solve this problem, in the conventional art, a panel having a high transmittance of no less than 85% was used. At this time, when assuming that R is a reflectance, k is an absorbance index and t is a thickness of glass, a transmittance $T_m$ can be calculated by the following equation:

$$T_m = (1 = R)^2 X e^{-k \cdot t} X 100(\%).$$

However, if the panel having a high transmittance is used, while it is possible to increase a brightness at a center part of a picture image, a distinguishability between lightness and darkness, that is, contrast which is a brightness ratio of the lightest to the darkest parts of the picture image when an illumination of an external light source is 200 lux, is deteriorated. In order to cope with this drawback, while a coating or an optical film can be applied or attached to the panel with a view to decrease a transmittance, a defect is caused in that additional processes and manufacturing costs are incurred to form the panel.

Therefore, in order to settle the defect, in the present invention, by keeping a transmittance of no greater than 75% at the center part of a picture image, it is possible to maintain a sufficient brightness while improving a distinguishability between lightness and darkness. Contrast depending upon transmittances in the same panel structure is given in TABLE 1.

TABLE 1

| | Transmittance at center part | Contrast | Transmittance ratio | Condition |
|---|---|---|---|---|
| 1 | 90% | 14.0 | 98.7% | Illumination of |
| 2 | 85% | 14.9 | 93.2% | External light |
| 3 | 80% | 16.0 | 87.8% | source: |
| 4 | 75% | 17.1 | 82.3% | 200 lux |

TABLE 1-continued

| | Transmittance at center part | Contrast | Transmittance ratio | Condition |
|---|---|---|---|---|
| 5 | 70% | 18.4 | 76.8% | Brightness at brightest part: 30 fL |
| 6 | 65% | 19.7 | 71.3% | |
| 7 | 60% | 21.1 | 65.9% | |
| 8 | 55% | 22.6 | 60.4% | |
| 9 | 50% | 24.2 | 54.9% | |
| 10 | 45% | 25.9 | 49.4% | |
| 11 | 40% | 27.6 | 43.9% | |

Figure 4:
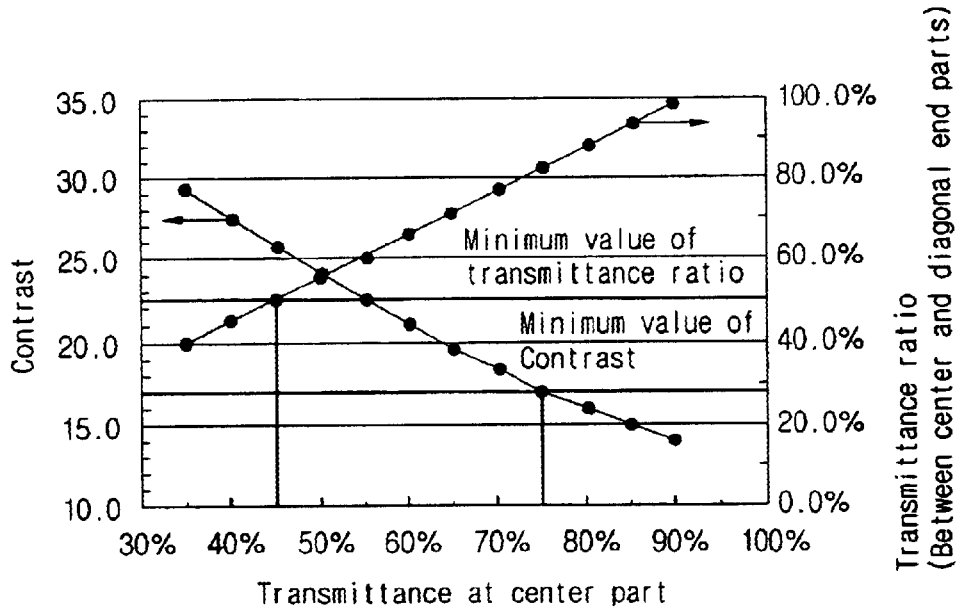
FIG. 4 is a graph illustrating contrast depending upon a transmittance at a center part of a panel.

As can be readily seen from TABLE 1and FIG. 4, in the case that a panel having at a center part thereof a high transmittance of no less than 85% is used, since contrast becomes no greater than 15, it is not easy to adequately distinguish lightness and darkness of a picture image. As a consequence, when a brightness of the external light source is substantial, a person is caused to feel eye strain.

Generally, it was known in the art that, in the cathode ray tube, when contrast is no less than 17, lightness and darkness can be adequately distinguished from each other without difficulty under a normal condition of external illumination. In actual fact, when a panel having a transmittance of no less than 85% is used in the conventional flat type cathode ray tube having a size of 29 inches, by applying a coating to the panel for the purpose of decreasing a transmittance, contrast is maintained at a value of no less than 17.

In the present invention, by maintaining a transmittance of no greater than 75%, contrast is increased, and thereby, a distinguishability between lightness and darkness is enhanced. Also, as can be readily seen from FIG. 4, when a transmittance of the center part of the panel is no greater than 45%, because a transmittance ratio between the center part and the diagonal end part of the panel becomes less than 50%, brightness uniformity of a picture image cannot but be degraded.

If a transmittance of no greater than 75% and the same panel curvature as in the conventional art are maintained, as a thickness of the diagonal end part of the panel is increased, a brightness is likely to be markedly decreased.

Figure 5A:
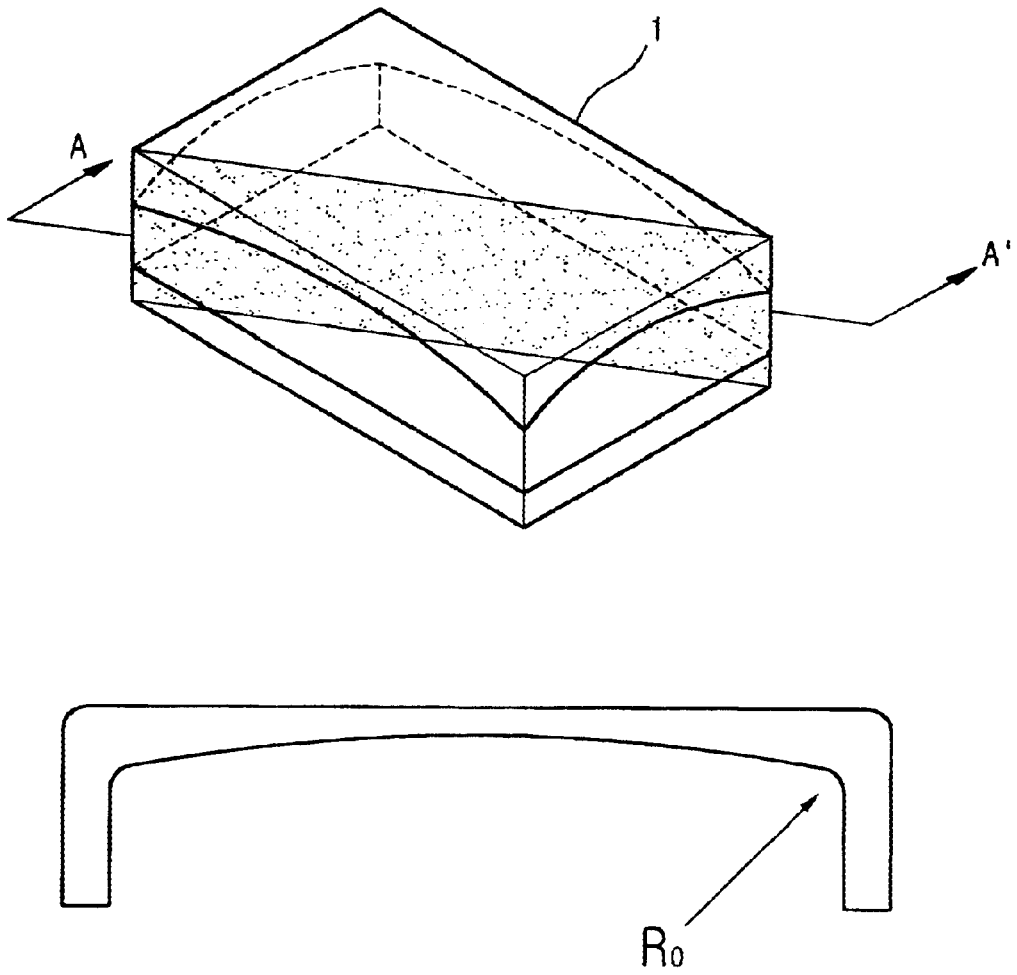
FIG. 5*a* shows views illustrating a representative radius of curvature at an effective surface end on a diagonal axis.
Figure 58:
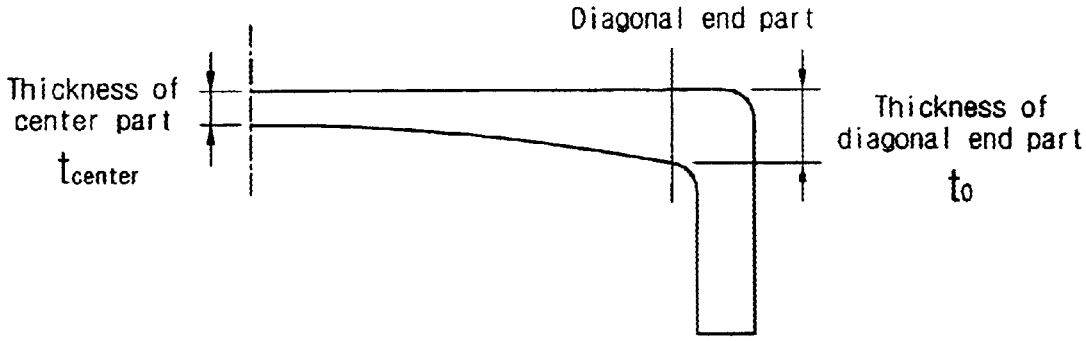

Accordingly, in the present invention, in order to decrease a thickness of the diagonal end part of the panel while maintaining a transmittance of no greater than 75%, and thereby improve flatness of a picture image, as can be readily understood from FIG. 5*a*, a representative radius of curvature $R_D$ along a diagonal axis and on the inner surface of the panel is designed to satisfy the following inequality (1):

$$3.5R \leqq R_D \leqq 8.0R \quad (1)$$

where R is a product of 1.767 and a diagonal length of an effective surface along the diagonal axis as a variable value.

Figure 3A:
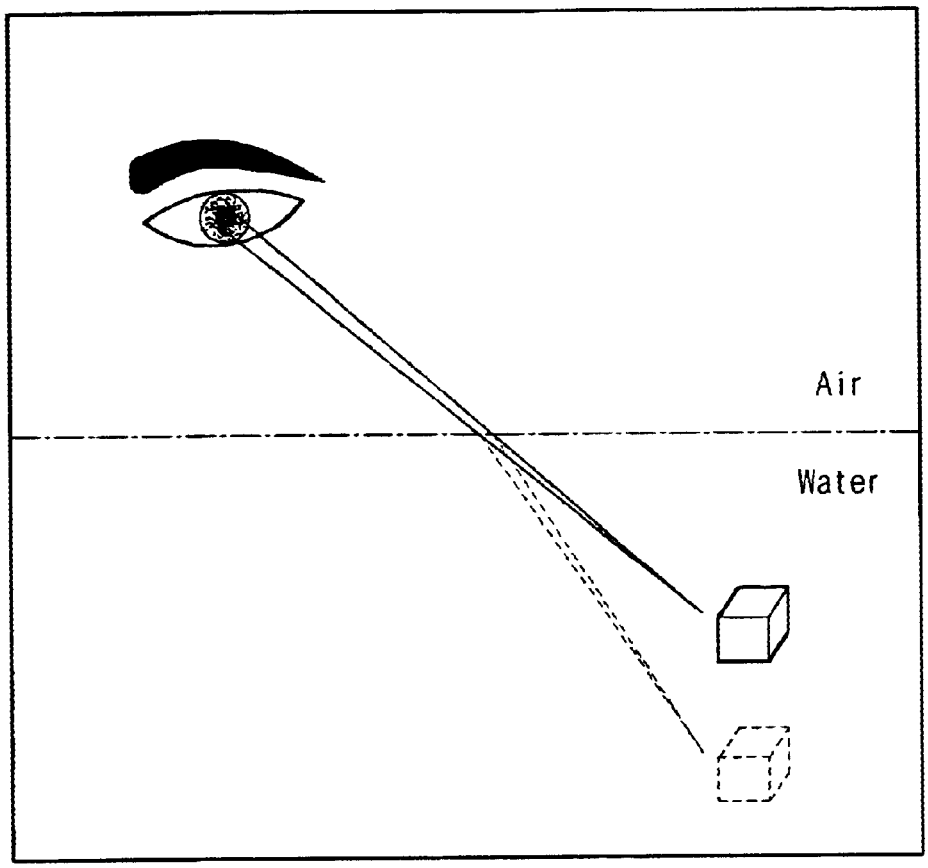
FIG. 3*a* is a diagrammatic view for explaining an image floating effect.
Figure 3B:
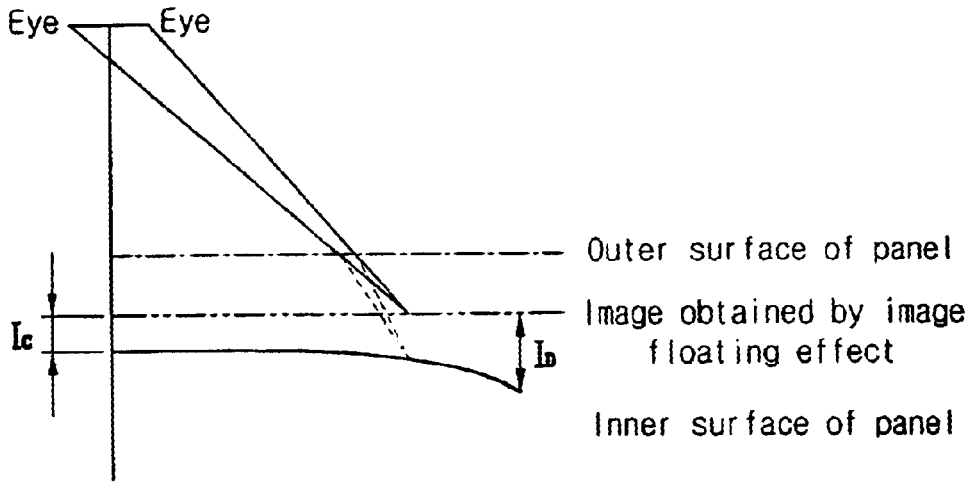
FIG. 3*b* is a diagrammatic view for explaining the image floating effect in a cathode ray tube.
Figure 3D:
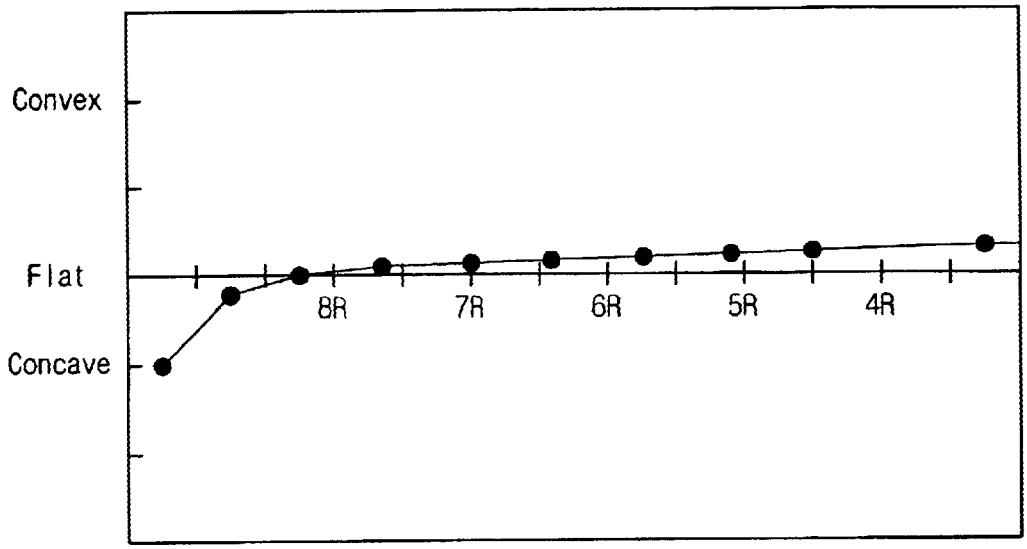
FIG. 3*d* is a schematic graph illustrating a relationship between a radius of curvature of a panel and a curvature of a picture image.

In the meanwhile, as shown in FIGS. 3*b* and 3*c*, an image floating phenomenon in which an image is floated in conformity with a refractive index and a thickness of the panel may occur in the picture image which is produced when electron beams are impinged onto fluorescent materials applied to the inner surface of the panel. By this image floating phenomenon, as can be readily seen from FIG. 3*d*, if a representative radius of curvature $R_D$ along the diagonal axis and on the inner surface of the panel is no less than 8R, by a floated amount $I_D$ of the diagonal end part of the panel, a concave picture image curved in a reverse direction is produced.

Also, if a representative radius of curvature $R_D$ along the diagonal axis and on the inner surface of the panel is no greater than 4R, since an image floating effect of the peripheral part is insufficient when compared to that of the center part, degradation of flatness of the picture image is caused.

In the inequality (1), in order to augment a strength and a howling characteristic of a shadow mask, which are influenced by the inner surface curvature of the panel, while improving flatness of the picture image, it is preferred that a representative radius of curvature $R_D$ along the diagonal axis and on the inner surface of the panel is designed to satisfy the following inequality (2):

$$4.0R \leqq R_D \leqq 5.0R \quad (2).$$

In a cathode ray tube having a panel which possesses a flat outer surface and a curved inner surface, an on-diagonal-axis curvature is regarded as a most important factor for determining an entire inner surface curvature. Moreover, an on-major-axis curvature and an on-minor-axis curvature must be established to define a contour substantially coinciding to that defined by the on-diagonal-axis curvature, thereby to prevent a picture image from being distorted.

In a conventional flat type cathode ray tube, in the case that an on-minor-axis curvature has an abnormally decreased size, as upper and lower parts of a picture image are not flat but curved, overall flatness of the picture image tends to be degraded.

Hence, in order to improve image quality and prevent flatness of a picture image from being degraded, an on-major-axis curvature $R_X$, an on-minor-axis curvature $R_Y$ and an on-diagonal-axis curvature $R_D$ must respectively satisfy the following inequalities (3), (4) and (5):

$$4.5R_{XO} \leqq R_X \leqq 8.0R_{XO} \quad (3)$$

$$2.5R_{YO} \leqq R_Y \leqq 8.0R_{YO} \quad (4)$$

$$3.5R_{DO} \leqq R_D \leqq 8.0R_{DO} \quad (5)$$

where $R_{XO}$, $R_{YO}$ and $R_{DO}$ are products of 1.767 and on-major-axis, on-minor-axis and on-diagonal-axis lengths, respectively, of an effective surface of the panel.

In the inequalities (3), (4) and (5), in order to augment a strength and a howling characteristic of the shadow mask, which are influenced by the inner surface curvature of the panel, while improving flatness of the picture image, it is preferred that an on-major-axis curvature $R_X$, an on-minor-axis curvature $R_Y$ and an on-diagonal-axis curvature $R_D$ respectively satisfy the following inequalities (6), (7) and (8):

$$5.0R_{XO} \leqq R_X \leqq 7.0R_{XO} \quad (6)$$

$$2.5R_{YO} \leqq R_Y \leqq 3.5R_{YO} \quad (7)$$

$$4.0R_{DO} \leqq R_D \leqq 5.0R_{DO} \quad (8).$$

Another one of important factors of a flat type cathode ray tube is brightness uniformity of the picture image.

Generally, in a cathode ray tube, brightness uniformity of a picture image, which provides viewing comfort, is considered as appropriate when a rate between a brightness of the diagonal end part and a brightness of the center part is no less than 50%.

In the conventional panel for a cathode ray tube, which has at the center part thereof a high transmittance of no less than 85%, while it is possible to secure brightness uniformity of no less than 50% because a thickness is increased at the diagonal end part of the panel, a distinguishability between lightness and darkness is deteriorated.

Referring to FIG. 4, it is appropriate that, in order to improve a distinguishability between lightness and darkness and at the same time secure brightness uniformity, a rate of a transmittance at the diagonal end part of the panel with respect to a transmittance at the center part of the panel is maintained within a range of no greater than 80%.

Also, in a state wherein contrast as a distinguishability between lightness and darkness is improved, in order to ensure that a rate of a transmittance at the diagonal end part of the panel with respect to a transmittance at the center part of the panel is maintained within a range of no greater than 80%, a thickness must be decreased at the peripheral part of the panel.

As a consequence, since an implosion-resistant characteristic of the cathode ray tube is deteriorated, a safety-related issue is raised with respect to the cathode ray tube.

If a transmittance ratio between the center part and the diagonal end part of the panel exceeds 80%, as a thickness is increased at the diagonal end part, a radius of curvature of the inner surface is increased. Thus, as a curvature of the shadow mask is also increased, a strength of the shadow mask, for withstanding external vibration, is diminished. As a result, since a howling characteristic of the shadow mask is deteriorated, quality of the cathode ray tube cannot but be degraded.

Accordingly, as described above, it is appropriate that a transmittance ratio between the center part and the diagonal end part of the panel is maintained within a range of no greater than 80%.

FIG. 5*a* shows views illustrating a representative radius of curvature at an effective surface end on a diagonal axis, and which is a thickness ratio between the center part and the diagonal end part of the panel, where $t_{center}$, $t_D$ are thicknesses of the center part, and the diagonal end part, respectively, of the panel.

When a transmittance of the center part of the panel is maintained within a range of 45%~75%, a wedge rate, which is a thickness ratio between the center part and the diagonal end part of the panel, can satisfy the following inequality (9):

$$1.4 \leqq \text{wedge rate} \leqq 2.0 \quad (9).$$

Transmittance ratios between the center part and the diagonal end part of the panel, depending upon wedge rates and center face thicknesses (CFTs) of the panel, are given in TABLE 2.

TABLE 2

| Wedge rate | CFT | Transmittance ratio between center part and diagonal end part |
|---|---|---|
| 1.1 | 12.0 | 96.1~94.6% |
| | 13.5 | 95.6~94.0% |
| | 15.0 | 95.1~93.3% |
| 1.4 | 12.0 | 85.2~80.1% |
| | 13.5 | 83.5~77.9% |
| | 15.0 | 81.8~75.8% |
| 1.7 | 12.0 | 75.5~67.8% |
| | 13.5 | 72.9~64.6% |
| | 15.0 | 70.4~61.5% |
| 2.0 | 12.0 | 67.0~57.4% |
| | 13.5 | 63.7~53.6% |
| | 15.0 | 60.6~50.0% |
| 2.3 | 12.0 | 59.4~48.6% |
| | 13.5 | 55.6~44.4% |
| | 15.0 | 52.1~40.6% |

As can be readily seen from TABLE 2, in a state wherein a transmittance of the center part of the panel is set to 45~75% in order to improve a distinguishability between lightness and darkness (contrast), if a wedge rate has a value of no less than 2.0, as a transmittance ratio between the center part and the diagonal end part of the panel has a value of no greater than 50%, brightness uniformity is degraded, and thereby eye strain is caused.

Further, the more a thickness ratio between the center part and the diagonal end part of the panel is increased, the more a thermal stress is excessively induced, due to a corresponding thickness difference, in a thermal process through which the panel passes, whereby a defective proportion is increased upon manufacture of panels.

If a wedge rate as a thickness ratio between the center part and the diagonal end part of the panel is no greater than 1.4, as a radius of curvature of the shadow mask is increased depending upon an inner surface curvature of the panel, a strength and a howling characteristic of the shadow mask are diminished.

In order to improve contrast as a distinguishability between lightness and darkness, when a transmittance of the center part of the panel is maintained within a range of 45~75%, an appropriate wedge rate satisfies the above-expressed inequality (9), and, as can be readily understood from FIG. 5, a thickness $t_{center}$ of the center part of the panel depending upon a wedge rate must satisfy the following inequality (10):

$$12 \text{ mm} \leqq t_{center} \leqq 15 \text{ mm} \quad (10).$$

Figure 2A:
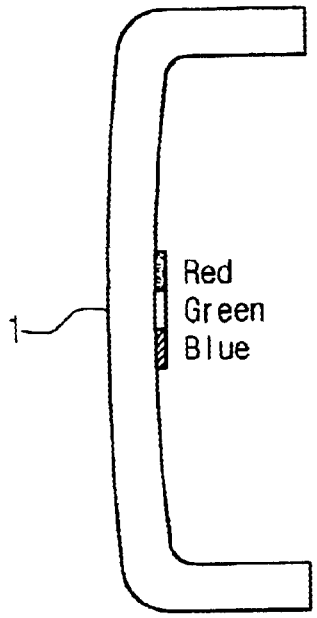
FIG. 2*a* is a side cross-sectional view independently illustrating a contour of a curved panel which has curvatures on both inner and outer surfaces thereof.
Figure 2B:
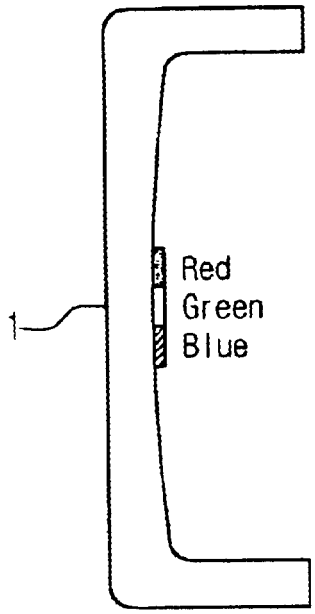
FIG. 2*b* is a side cross-sectional view independently illustrating a contour of a flat panel which has a curvature only on an inner surface thereof.

At this time, it is to be noted that a thickness of the center part of the panel is related with an implosion-resistant characteristic and safety of the finally-produced cathode ray tube. If a thickness of the center part of the panel is less than 12 mm, while a transmittance at the diagonal end part of the panel can be increased under the same wedge rate to improve brightness uniformity of the picture image, as an implosion-resistant characteristic is degraded, the likelihood of a cathode ray tube to implode upon impact test is increased, and thereby, a safety-related issue is raised. On the other hand, if a thickness of the center part of the panel is greater than 15 mm in consideration of safety, while impact resistance is ameliorated to improve an implosion-resistant characteristic, nevertheless, as can be readily seen from FIG. 2, since a transmittance of the peripheral part has a low value and a transmittance ratio between the center part and the diagonal end part of the panel is decreased, it is difficult to properly maintain brightness uniformity over the picture image.

Thus, when a transmittance of the center part of the panel is within a range of 45~75% and a wedge rate satisfies the above inequality (9), a thickness of the center part of the panel must satisfy the inequality (10).

As apparent from the above description, the flat type color cathode ray tube according to the present invention, including a panel which has a flat outer surface and a curved inner surface, provides advantages in that, since a transmittance of a center part of the panel is maintained within a range of 45~75%, a distinguishability between lightness and darkness (contrast) as one of major characteristics determining image quality is improved.

Also, because a representative curvature of the inner surface is maintained within a predetermined range, it is possible to prevent brightness uniformity, which forms another characteristic of the cathode ray tube having a high transmittance of no less than 85%, from being deteriorated.

Further, it is possible to improve flatness of a picture image while not degrading a vibration-resistant characteristic of a shadow mask which is influenced by a curvature of a panel. Moreover, by appropriately delimiting a thickness ratio between the center part and a diagonal end part of the panel and a thickness of the center part, it is possible to minimize a defective proportion upon manufacture of cathode ray tubes.

Furthermore, contrast and brightness uniformity can be complementarily improved while not incurring additional processes and manufacturing costs, whereby it is possible to enhance flatness and visual distinction of a resultant picture image.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A flat type color cathode ray tube comprising:

a rectangular panel having an outer surface which is substantially flat and an inner surface which takes a predetermined curvature, the rectangular panel being formed with a skirt part which extends substantially perpendicularly to the inner and outer surfaces;

a shadow mask for performing a function of selecting colors of emitted electron beams in the panel;

a frame for applying tensioning force to the shadow mask and supporting the shadow mask;

a funnel coupled to a rear end of the panel to maintain the inside of the panel under a vacuum pressure;

a tubular neck section extending rearward from a rear end of the funnel;

an electron gun mounted in the neck section to emit electron beams; and a deflection yoke surrounding a circumferential outer surface of the funnel to deflect electron beams;

wherein the panel possesses at a center part thereof a transmittance of 45%~75%, and the inner surface of the panel possesses an on-diagonal-axis curvature $R_D$ which satisfies the following inequality (1):

$$3.5R \leqq R_D \leqq 8.0R \quad (1)$$

where R is a product of 1.767 and a diagonal length of an effective surface along the diagonal axis.

2. The flat type color cathode ray tube as set forth in claim 1, wherein the inner surface of the panel possesses an on-major-axis curvature $R_X$, an on-minor-axis curvature $R_Y$ and an on-diagonal-axis curvature $R_D$ which respectively satisfy the following inequalities (3), (4) and (5):

$$4.5R_{XO} \leqq R_X \leqq 8.0R_{XO} \quad (3)$$

$$2.5R_{YO} \leqq R_Y \leqq 8.0R_{YO} \quad (4)$$

$$3.5R_{DO} \leqq R_D \leqq 8.0R_{DO} \quad (5)$$

where $R_{XO}$, $R_{YO}$, $R_{DO}$ are products of 1,767 and on-major-axis, on-minor-axis and on-diagonal-axis lengths, respectively, of an effective surface of the panel.

3. The flat type color cathode ray tube as set forth in claim 1, wherein a transmittance ratio between the center part and a diagonal end part of the panel is 50~80%.

4. A flat type color cathode ray tube comprising:

a rectangular panel having an outer surface which is substantially flat and an inner surface which takes a predetermined curvature, the rectangular panel being formed with a skirt part which extends substantially perpendicularly to the inner and outer surfaces;

a shadow mask for performing a function of selecting colors of emitted electron beams in the panel;

a frame for applying tensioning force to the shadow mask and supporting the shadow mask;

a funnel coupled to a rear end of the panel to maintain the inside of the panel under a vacuum pressure;

a tubular neck section extending rearward from a rear end of the funnel;

an electron gun mounted in the neck section to emit electron beams; and a deflection yoke surrounding a circumferential outer surface of the funnel to deflect electron beams;

wherein the panel possesses at a center part thereof a transmittance of 45%~75%, and the inner surface of the panel possesses an on-diagonal-axis curvature $R_D$ which satisfies the following inequality (2):

$$4.0R \leqq R_D \leqq 5.0R \quad (2)$$

where R is a product of 1.767 and a diagonal length of an effective surface along the diagonal axis.

5. The flat type color cathode ray tube as set forth in claim 4, wherein the inner surface of the panel possesses an on-major-axis curvature $R_X$, an on-minor-axis curvature $R_Y$ and an on-diagonal-axis curvature $R_D$ which respectively satisfy the following inequalities (6), (7) and (8):

$$5.0R_{XO} \leqq R_X \leqq 7.0R_{XO} \quad (6)$$

$$2.5R_{YO} \leqq R_Y \leqq 3.5R_{YO} \quad (7)$$

$$4.0R_{DO} \leqq R_D \leqq 5.0R_{DO} \quad (8)$$

where $R_{XO}$, $R_{YO}$, $R_{DO}$ are products of 1,767 and on-major-axis, on-minor-axis and on-diagonal-axis lengths, respectively, of an effective surface of the panel.

6. The flat type color cathode ray tube as set forth in claim 4, wherein a transmittance ratio between the center part and a diagonal end part of the panel is 50~80%.

7. A flat type color cathode ray tube comprising:

a rectangular panel having an outer surface which is substantially flat and an inner surface which takes a predetermined curvature, the rectangular panel being formed with a skirt part which extends substantially perpendicularly to the inner and outer surfaces;

a shadow mask for performing a function of selecting colors of emitted electron beams in the panel;

a frame for applying tensioning force to the shadow mask and supporting the shadow mask;

a funnel coupled to a rear end of the panel to maintain the inside of the panel under a vacuum pressure;

a tubular neck section extending rearward from a rear end of the funnel;

an electron gun mounted in the neck section to emit electron beams; and a deflection yoke surrounding a circumferential outer surface of the funnel to deflect electron beams;

wherein the panel possesses at a center part thereof a transmittance of 45%~75%, and the panel further possesses a wedge rate as a thickness ratio between the center part and a diagonal end part of the panel, which satisfies the following inequality (9):

$$1.4 \leqq \text{wedge rate} \leqq 2.0 \quad (9).$$

8. The flat type color cathode ray tube as set forth in claim 7, wherein a transmittance ratio between the center part and the diagonal end part of the panel is 50~80%.

9. The flat type color cathode ray tube as set forth in claim 7, wherein a thickness $t_{center}$ of the center part of the panel satisfies the following inequality (10):

$$12\ \text{mm} \leqq t_{center} \leqq 15\ \text{mm} \quad (10).$$

10. The flat type color cathode ray tube as set forth in claim 7, wherein the inner surface of the panel possesses an on-diagonal-axis curvature $R_D$ which satisfies the following inequality (1):

$$3.5R \leqq R_D \leqq 8.0R \quad (1)$$

where R is a product of 1.767 and a diagonal length of an effective surface along the diagonal axis.

11. The flat type color cathode ray tube as set forth in claim 10, wherein the inner surface of the panel possesses an on-major-axis curvature $R_X$ and an on-minor-axis curvature $R_Y$ which respectively satisfy the following inequalities (3) and (4), where $R_{XO}$, $R_{YO}$ are products of 1.767 and on-major-axis, and on-minor-axis lengths, respectively, of an effective surface of the panel:

$$4.5R_{XO} \leqq R_X \leqq 8.0R_{XO} \ldots \quad (3)$$

$$2.5R_{YO} \leqq R_Y \leqq 8.0R_{YO} \ldots \quad (4).$$

12. The flat type color cathode ray tube as set forth in claim 7, wherein the inner surface of the panel possesses an on-diagonal-axis curvature $R_D$ which satisfies the following inequality (2), where R is a product of 1.767 and a diagonal length of an effective surface along the diagonal axis:

$$4.0R \leqq R_D \leqq 5.0R \ldots \quad (2).$$

13. The flat type color cathode ray tube as set forth in claim 12, wherein the inner surface of the panel possesses an on-major-axis curvature $R_X$ and an on-minor-axis curvature $R_Y$ which respectively satisfy the following inequalities (6) and (7), where $R_{XO}$, $R_{YO}$ are products of 1.767 and on-major-axis, and on-minor-axis lengths, respectively, of an effective surface of the panel:

$$5.0R_{XO} \leqq R_X \leqq 7.0R_{XO} \ldots \quad (6)$$

$$2.5R_{YO} \leqq R_Y \leqq 3.5R_{YO} \ldots \quad (7).$$

* * * * *